US007081013B2

(12) United States Patent
Yamaguchi et al.

(10) Patent No.: US 7,081,013 B2
(45) Date of Patent: Jul. 25, 2006

(54) STRUCTURE OF REMOVABLE ELECTRICAL CONNECTOR

(75) Inventors: Noboru Yamaguchi, Shizuoka (JP); Masahito Ozaki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 48 days.

(21) Appl. No.: 10/860,588

(22) Filed: Jun. 4, 2004

(65) Prior Publication Data

US 2004/0253869 A1 Dec. 16, 2004

(30) Foreign Application Priority Data

Jun. 11, 2003 (JP) ..... 2003-166894

(51) Int. Cl.
*H01R 13/73* (2006.01)

(52) U.S. Cl. ..... 439/562

(58) Field of Classification Search ..... 439/246–248, 439/552, 557, 562
See application file for complete search history.

(56) References Cited

U.S. PATENT DOCUMENTS 4,027,937 A * 6/1977 Norden ..... 439/376
5,372,523 A * 12/1994 Sakatani et al. ..... 439/552
5,803,758 A * 9/1998 Kameyama ..... 439/248
6,123,579 A * 9/2000 Ping ..... 439/557
6,210,217 B1 * 4/2001 Ping ..... 439/557
6,497,579 B1 * 12/2002 Garbini ..... 439/63
6,568,959 B1 * 5/2003 Lo ..... 439/608
6,638,099 B1 * 10/2003 Nakamura ..... 439/489
6,767,246 B1 * 7/2004 Quinn et al. ..... 439/555

FOREIGN PATENT DOCUMENTS

JP 7-249454 9/1995

* cited by examiner

*Primary Examiner*—Gary F. Paumen
*Assistant Examiner*—Larisa Tsukerman
(74) *Attorney, Agent, or Firm*—Armstrong, Kratz, Quintos, Hanson & Brooks, LLP

(57) ABSTRACT

For providing a removable electrical connector to be attached and removed easily without being damaged, a structure of the removable electrical connector has a receiving part, a pivoting part, an engaging and disengaging part, and a rotation allowing part. The removable electrical connector is pivoted around a first edge of the connector housing of the pivoting part. A second edge opposed to the first edge of the removable electrical connector of the engaging and disengaging part is engaged with and disengaged from the receiving part of a mating connector or a mating equipment. The rotation allowing part allows the removable electrical connector to rotate around the pivoting part.

4 Claims, 10 Drawing Sheets

STRUCTURE OF REMOVABLE ELECTRICAL CONNECTOR

FIELD OF THE INVENTION

The present invention is related to a structure of a removable connector for allowing an optical connector to be attached to and removed from electronic equipment easily, where the optical connector receives terminals of optical fibers, and the optical fibers transmit optical signals.

DESCRIPTION OF THE RELATED ART

Various types of electronic equipment are mounted on a vehicle. In a vehicle, a wire harness is arranged for transmitting specific electric power and signals to the electronic equipment. The wire harness has a plurality of wires and connectors for transmitting signals. An electric wire, having a conductive core and a sheath for covering the core, and an optical cable, having an optical fiber and a clad for covering the fiber, are used as the wires. The connector has a metal terminal (for example, a ferrule) and a connector housing for receiving the metal terminal.

Some of the connectors of the wire harness arranged in a vehicle are connected to each other, and other connectors are connected to the electronic equipment. These connections between the connectors and connections between the connectors and the electronic equipment are removable for easy maintenance.

Various structures of a connector (one example is shown in Japanese Patent Application Laid-Open No. Hei 07-249454, hereinafter referred to as "the Patent Document 1") are used for obtaining a removable electrical connector to connect removably to the mating connector, or to the electronic equipment. The Patent Document 1 discloses a structure of a pair of removable electrical connectors. A connector housing of each connector has a triangular pyramid projection and a hole with which the projection of the other connector is engaged.

In the structure as disclosed by the Patent Document 1, one connector is moved close into a mating connector in a longitudinal direction of a metal terminal received by a connector housing of the mating connector, and pressed into the mating connector against resiliency of connector housings of both connectors. Then, a projection of the mating connector is engaged with a hole of the one connector to attach the connectors together. In addition, when pressing the one connector into the connector housing, connector housings of both connectors are resiliently deformed by hitting the projection with the housing of the one connector.

According to the structure of a removable electrical connector as disclosed by the Patent Document 1, when removing the one connector from the mating connector, the one connector is pulled in the longitudinal direction of the metal terminal against the resiliency of both connector housings. Then, the hole is removed from the projection to be removed from the mating connector. In addition, when the one connector is removed from the mating connector, the connector housing of the one connector is deformed by hitting the projection of the mating connector.

Thus, in the structure of a removable electrical connector as disclosed by the Patent Document 1, the connectors are allowed to be removable by having the projection and the hole.

However, in the structure of a removable electrical connector described above, when removing from the mating connector, the one connector housing is deformed by hitting the projection. Further, in the structure of a removable electrical connector described above, the one connector is moved close into, or removed from the mating connector in a longitudinal direction of the metal terminal of the mating connector. Therefore, force for attaching and removing the connectors, which is given to the connectors, tends to be large. Therefore, it is difficult to removably attach the connectors together, so that a workability of engaging and disengaging the connectors tends to be decreased.

Further, because the force given to the connectors tends to be large, some tool is expected to be used, in particular, for removing from the mating connector. However, the projection of the mating connector may be damaged by the tool.

The present invention has been accomplished to solve the above described problems and an object of the present invention is to provide a structure for a removable electrical connector to be attached and removed easily without being damaged.

SUMMARY OF THE INVENTION

In order to attain the object, according to the present invention, there is provided a structure of a removable electrical connector having a connector housing comprising:

a receiving part having a frame-like opening to receive one end of the connector housing;

a pivoting part having a first edge of the one end of the connector housing around which the connector housing is freely rotatable;

an engaging and disengaging part having a second edge opposite to the first edge of the connector housing, the second edge being engaged with and disengaged from the receiving part;

a rotation allowing part for allowing the connector housing to be rotated around the pivoting part, whereby when the connector housing is rotated around the pivoting part, the engaging and disengaging part is engaged with and disengaged from the receiving part and the removable electrical connector is attached to and removed from the receiving part.

Preferably, according to the present invention, there is provided the structure of a removable electrical connector, wherein the pivoting part further includes a pivot projection projecting outward from the first edge of the connector housing, and a concave formed at an inner side surface of the receiving part to receive the pivot projection movably, wherein the engaging and disengaging part further includes an engaging projection projecting outward from the second edge of the connector housing to be engaged with the receiving part, wherein the rotation allowing part includes one inclined surface at an inner side of the receiving part adjacent to the pivoting part, the inclined surface being inclined outward from the receiving part, wherein in a state where the pivot projection is inserted into the concave, and the engaging projection is engaged with the connector housing, the pivot projection is movable in a insertion direction of the connector housing.

Preferably, according to the present invention, there is provided the structure of a removable electrical connector, satisfying the following relations:

$$L11*\sin\theta 1-d*(1-\cos\theta 1)\leqq L1\ \theta 2<\theta 1,$$

wherein d is a width of the pivot projection,

L1 is a difference between a width of the concave in an insertion direction of the connector housing to the receiving part and the width d of the pivot projection, L11 is a projection length of the pivot projection, θ1 is an angle between the inclined surface and an outer side surface of the connector housing adjacent to the first edge, the connector housing being in a first state where the pivot projection is in the concave, the engaging projection is engaged with the receiving part, and the connector housing is urged in an outward direction from the receiving part, and θ2 is an angle between the outer side surface of the connector housing adjacent to the first edge in the first state, and the same outer side surface of the connector housing in a second state, the connector housing being in the second state where the pivot projection is in the concave, the engaging projection is engaged with the receiving part, the first edge of the connector housing is urged in an inward direction from the receiving part, and the second edge of the connector housing is urged in an outward direction from the receiving part. Preferably, according to the present invention, there is provided the structure of a removable electrical connector, satisfying the following relation:

$$\theta 2=\arcsin(L1/L2),$$

wherein L2 is a sum of the projection length of the pivot projection L11 and a width of the connector housing in a direction perpendicular to both first and second edges.

According to above, by rotating the connector housing around the pivoting part, the engaging portion is engaged from and disengaged with the receiving part to allow the connector housing to be removable. Therefore, by pressing a position distant from the pivoting part on the connector housing, according to the principle of leverage, the force given to the connector housing to attach and remove the removable electrical connector can be reduced. Namely, the removable electrical connector can be attached and removed by the force less than the force in a longitudinal direction of the metal terminal received by the connector housing.

FIG. 9 shows a schematic view of a comparing a conventional structure A of a removable electrical connector, which is disclosed by the Patent Document 1. FIG. 8 shows a structure B of a removable electrical connector according to the present invention. Each figure shows a disengagable connector housing 5 of a connector 3, the connector housing 5 being engaged with and disengaged from a frame-shape receiving part 24 of such as electronic equipment 21.

In the conventional structure A, as shown in FIG. 9, a projection 100 is formed at each edge in a width direction of the connector housing 5. A concave 101, to be engaged with the projection 100, is formed at the receiving part 24. In this structure A, by moving the connector 3 in a direction of an arrow F parallel to a longitudinal direction of a metal terminal (not shown) received in the connector housing 5, the projection 100 is engaged with and disengaged from the concave 101.

In the structure B of the present invention as shown in FIG. 8, a pivot projection 30 is formed on a first edge 29*a*. An engaging projection 32 is formed on a second edge 29*b* opposite the first edge 29*a*. Both the pivot projection 30 and the engaging projection 32 are projected outward in a width direction of the connector housing 5. The engaging projection 32 is allowed to engage the connector housing 5 at an inner edge of the receiving part disengagably.

Further, a hole 31 as a concave, into which the pivot projection 30 is inserted movably, is formed in the receiving part 24. In the hole 31, the pivot projection 30 is movable in a longitudinal direction of the metal terminal, namely, in an insertion direction of the connector housing 5 inward from the receiving part 24. Namely, there remains a space inside the hole 31 after an insertion of the pivot projection 30. Further, one inner side surface of the receiving part 24, facing the first edge 29*a* is an inclined surface 33. The inclined surface 33 is inclined outward from the receiving part 24.

In the structure B of the present invention as described above, after inserting the pivot projection 30 into the hole 31, the connector housing 5 is rotated along an arrow K shown in the FIG. 8 around the pivot projection 30 in the hole 31. Then, the connector housing 5, as a connector 3, becomes able to be attached by engaging the engaging projection 32 with an inner edge of the receiving part 24, and to be removed by disengaging the engaging projection 32 from the inner edge of the receiving part 24. In this case, because the inclined surface 33 is inclined outward, the connector housing 5 as the connector 3 can be rotated without being blocked by a body of the electronic equipment 21.

Further, H2 is a width of the connector housing 5 in the conventional structure A and the structure B of the present invention. In the conventional structure A as shown in FIG. 9, when the projection 100 is engaged with the concave 101, the connector housing 5 is pulled out from the receiving part 24 by force F1. A moment M1 acting on the projection 100 to release the projection 100 from the concave 101 can be expressed by the following formula (1):

$$M1=H2/2*F1 \quad (1).$$

In the structure B of the present inventions as shown in FIG. 8, when the pivot projection 30 is in the hole 31, the connector housing 5 as a connector 3 is rotated around the pivot projection 30 in the hole 31. In this case, force F2 is given at a position having a distance H2 from the pivot projection 30 in a direction perpendicular to the longitudinal direction of the metal terminal.

Suppose that the force F2 disengages the engaging projection 32 from the inner edge of the receiving part 24. In this case, a moment M2 acting on the engaging projection 32 to disengage the engaging projection 32 from the inner edge of the receiving part 24 can be expressed by the following formula (2):

$$M2=H2*F2 \quad (2).$$

Suppose that the moment M1 to disengage the projection 100 in the structure A is equal to the moment M2 to disengage the engaging projection 32 in the structure B of this invention. Then, following formula (3) is derived:

$$H2/2*F1=H2*F2$$

$$1/2*F1=F2 \quad (3)$$

Thus, the force F2 of the structure B of the present invention is half the force of the force F1 of the conventional structure A. Further, in the case of attaching the connector 3 to the receiving part 24, the force F2 is also half the force of the force F1. Therefore, in the structure B of the present invention, the connector can be attached and removed by a lower force than in the conventional structure, such as the structure A disclosed by the Patent Document 1.

According to the present invention, when the connector housing is arranged at the pivoting part, the pivot projection projecting outward from the first edge of the connector housing is movable in the concave in an insertion direction of the connector housing. Therefore, when the connector housing is rotated around the pivoting part, the pivot projection and the concave can be prevented from blocking each other.

Further, the inclined surface is inclined outward, and arranged adjacent to an edge corresponding to the first edge of the connector housing, at an inner side of the receiving part. Therefore, when the connector housing is rotated around the pivoting part, the inner side surface as the inclined surface of the receiving part and the outer side surface of the connector housing can be prevented from blocking each other.

Therefore, the connector housing can be reliably rotated around the pivoting part, so that the connector can be attached to and removed from the receiving part reliably.

According to the structure B of the present invention, for reliably attaching the connector 3 to the receiving part 24 from a state where the connector 3 is separated from the receiving part 24, it is necessary to reliably insert the pivot projection 30 into the receiving part 24. Further, in the structure B, as a distance L1 between a width of the hole 31 and a width of the pivot projection 30 becomes longer, the pivot projection 30 can be inserted into the hole 31 easier. Further, in the structure B, as a projecting length L1 from the connector housing 5 of the pivot projection 30 becomes longer, the width L1 must be made wider.

As shown in FIG. 8, in the structure B of the present invention, in a state where the pivot projection 30 is in the hole 31, and the engaging projection 32 is engaged with the inner edge of the receiving part 24, the connector housing 5 is urged in an outward direction from the receiving part 24. In this case, θ1 is an angle between the inclined surface 33 and an outer side surface 5*b* of the connector housing 5 adjacent to the first edge.

As shown in FIGS. 11 and 12, the outer side surface 5*b* of the connector housing 5 adjacent to the first edge is in face-contact with the inclined surface 33. For inserting the pivot projection 30 into the hole 31, said angle θ1, the width d of said pivot projection 30, the difference L1 and the projecting length L11 should satisfy the following formulas (4) and (5):

$$L11*\sin\theta1+d*\cos\theta1\leqq L1+d \quad (4)$$

$$L11*\sin\theta1-d*(1-\cos\theta1)\leqq L1 \quad (5).$$

Namely, by satisfying the formula (5), the pivot projection 30 can be reliably inserted into the hole 31, and the connector 3 can be reliably attached to the receiving part 24.

Further, for removing the connector 3 from the receiving part 24 reliably from the state where the pivot projection 30 is in the hole 31 and the engaging projection 32 is engaged with the inner edge of the receiving part 24, the connector 3 is needed to be rotated sufficiently. For this purpose, as shown in FIG. 10, while the pivot projection 30 is in the hole 31 and the engaging projection 32 is engaged with the inner edge of the receiving part 24, the pivot projection 30 is urged in an inward direction from the receiving part 24, and the engaging projection 32 is urged in an outward direction from the receiving part 24. θ2 is an angle between the outer surfaces 5*b* adjacent to the first edge 29*a* in a state shown in FIG. 10 and in a state where the outer surfaces 5*b* adjacent to the first edge 29*a* is contacted with the inclined surface of the receiving part 24 shown in FIG. 11. Said θ2 is shown as an alternate long and short dash line in FIG. 10. For removing the connector 3 from the receiving part 24, the angle θ2 should satisfy the following formula (6):

$$\theta2<1 \quad (6).$$

Namely, by satisfying the formula (6), the connector 3 can be removed from the receiving part 24.

As shown in FIG. 10, suppose that L2 is a sum of the width H2 of the connector housing 5 and the projection length L11 of the pivot projection 30, said L2 and said θ2 should satisfy the following formula (7):

$$\theta2=\arcsin(L1/L2) \quad (7)$$

Namely, by satisfying the formula (7), the connector 3 can be removed from the receiving part 24.

According to the present invention, because the structure of the present invention satisfies the formula (5), the pivot projection can be reliably inserted into the concave. Namely, the connector can be attached reliably to the receiving part. Further, because this structure of the present invention satisfies the formula (6), the connector can be reliably removed from the receiving part.

According to the present invention, because the structure of the present invention satisfies the formula (7), the connector can be reliably removed from the receiving part.

DESCRIPTION OF THE PREFERRED EMBODIMENT

One embodiment of a structure 1 of a removable electrical connector according to the present invention will be described with reference to the attached drawings. The structure 1 of this embodiment allows an optical connector 3 for use in electrical equipment 2 of a vehicle to be removable.

Figure 1:
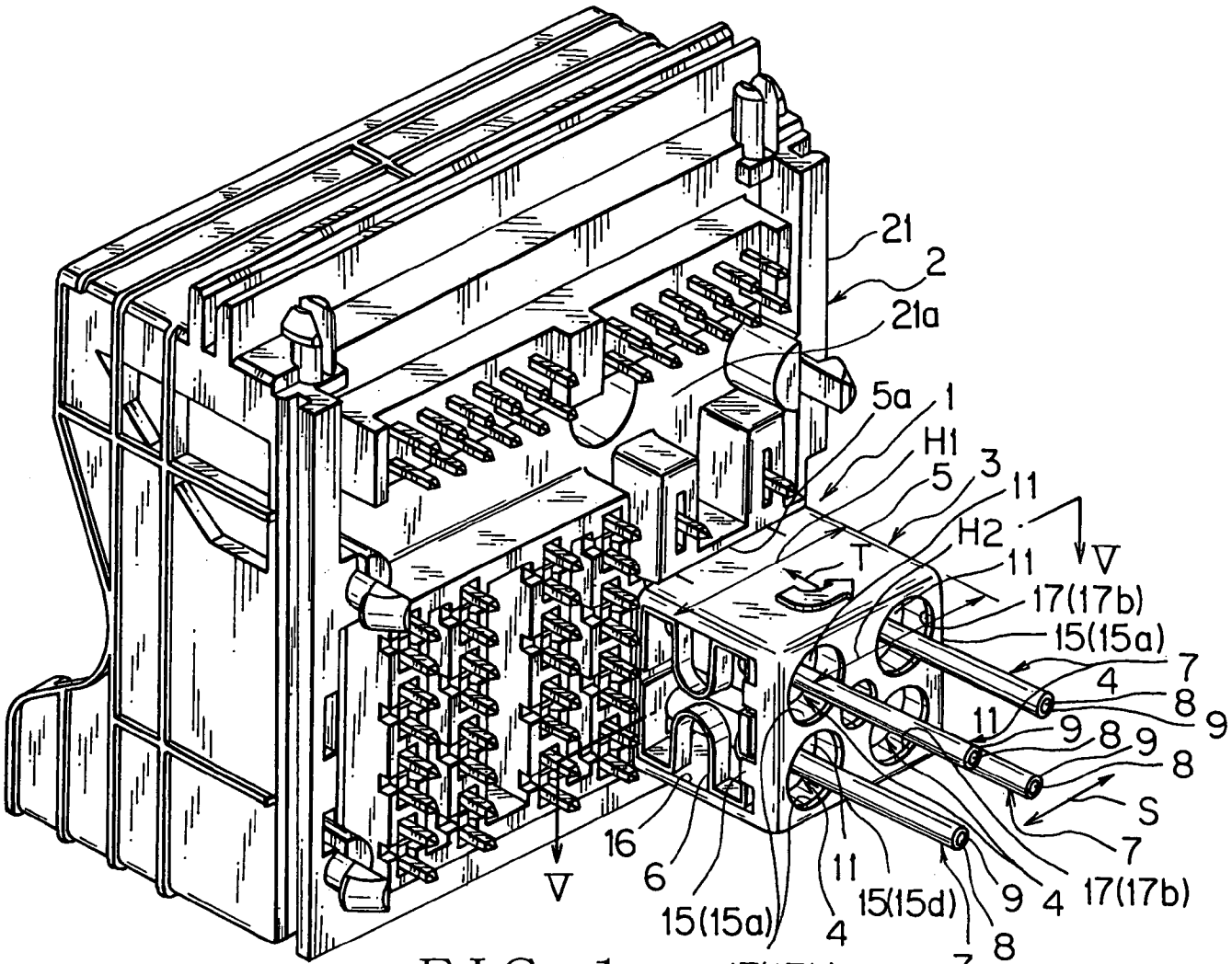
FIG. 1 is a perspective view showing an optical connector and an electrical equipment being connected together, and having one embodiment of a structure of a removable electrical connector according to this invention.
Figure 2:
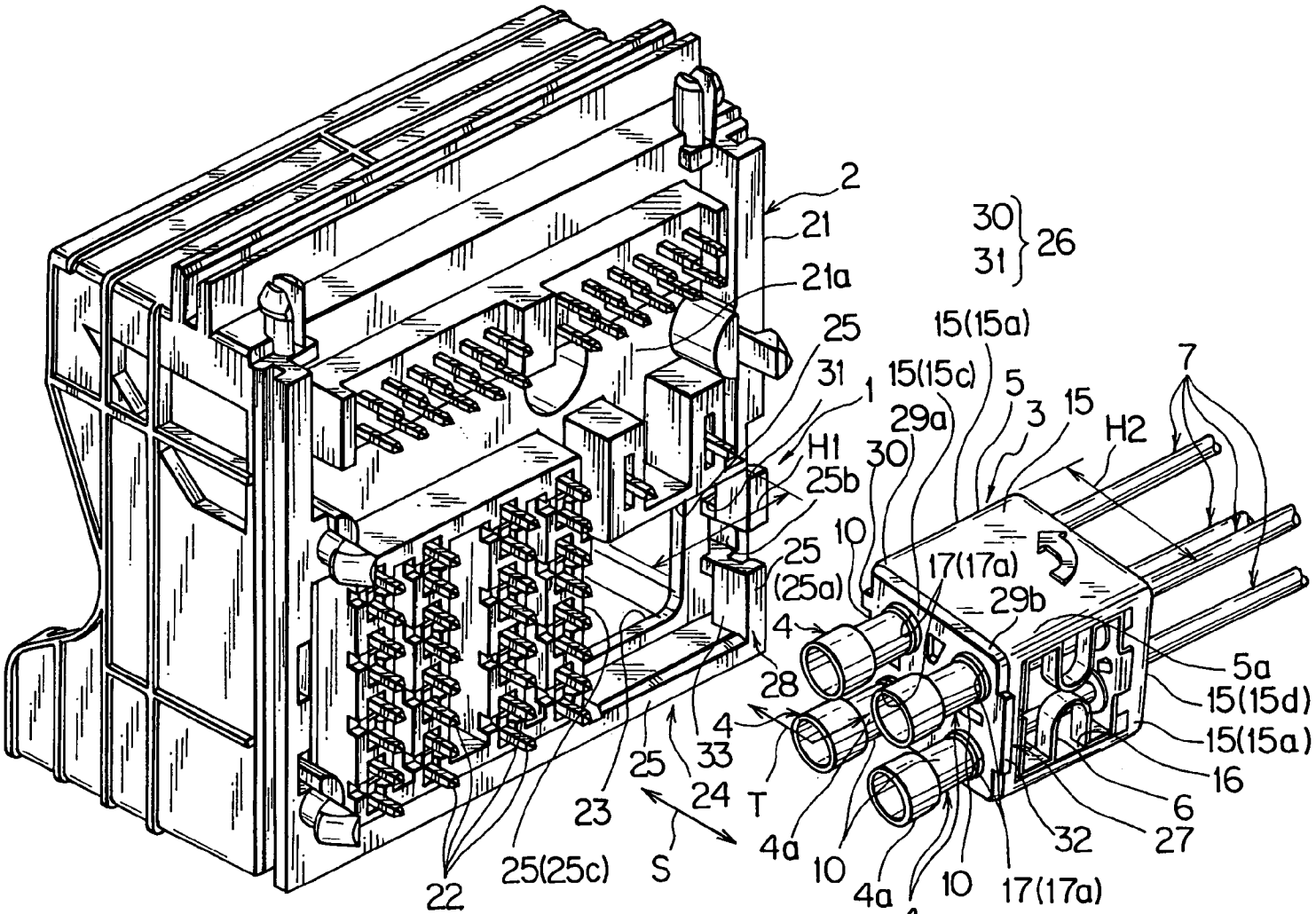
FIG. 2 is a schematic view showing the optical connector and the electrical equipment of FIG. 1, being separated from each other.

As shown in FIGS. 1 and 2, the electrical equipment 2 has a body 21 made of synthetic resin, a plurality of terminals 22 embedded in the body 21, a through hole 23, and a receiving part 24 for receiving a mating connector (hereinafter referred to as "receiving part"). The body 21 has a box-like shape. One end of each terminal 22 projects outside of the body 21, the other end projects inside the body, and a middle of each terminal 22 is embedded in the body 21. The one end of each terminal 22 is connected to a mating terminal of various connectors (not shown).

The through hole 23 penetrates an outer wall 21*a* of the body 21, as shown in FIG. 1. The through hole 23 has a rectangular shape. The receiving part 24 is formed at peripheral edges of the through hole 23, and has a frame-like shape made of four beams 25. The receiving part 24 receives an end part 5*a* of a connector housing 5 of the optical connector 3 as shown in FIGS. 1 and 2. According to the structure 1 of a removable electrical connector as described below, the optical connector 3 is attached to, and removed from the receiving part 24. Further, as shown in FIG. 2, a width H1 between a pair of beams facing each other along an arrow I of the receiving part 24 is equal to a width H2 of the connector housing 5 along an arrow S.

Figure 3:
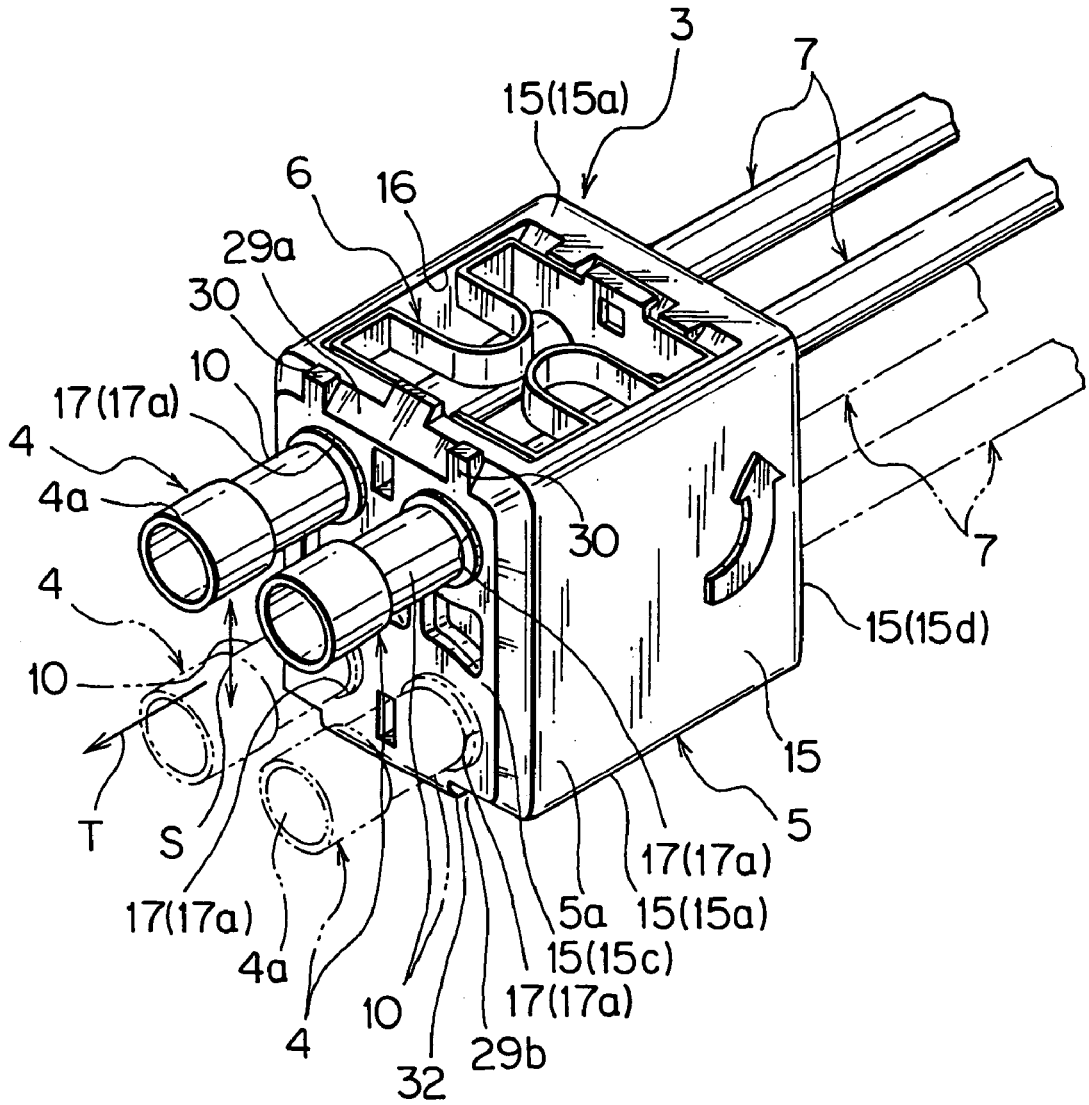
FIG. 3 is a perspective view showing the optical connector of FIG. 1.
Figure 4:
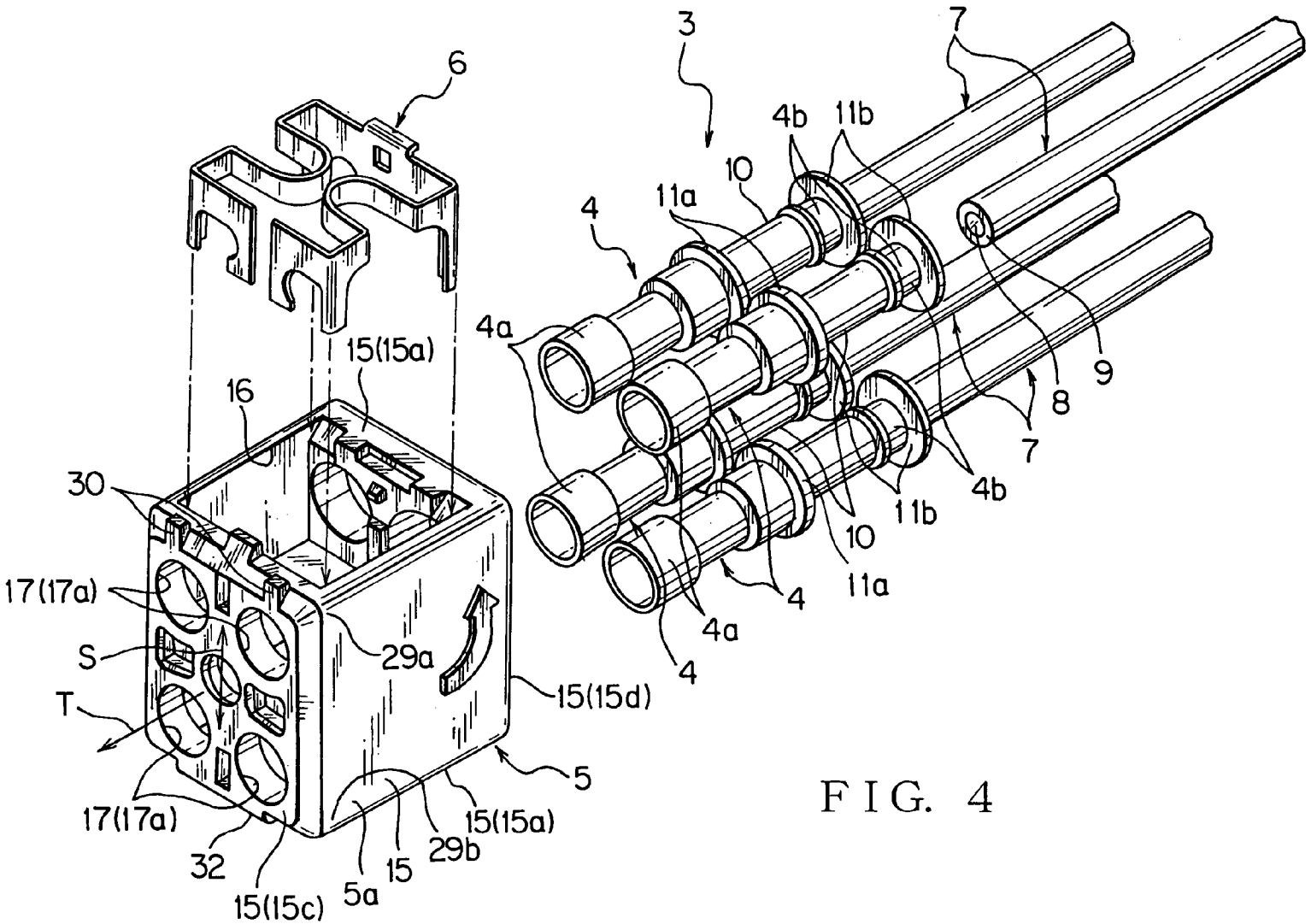
FIG. 4 is an exploded perspective view showing the optical connector of FIG. 3.

As shown in FIGS. 3 and 4, the optical connector 3 has a quartet of ferrules 4, connector housing 5 and flat springs 6 as an urging means. The ferrule 4 is made of metal, and has a cylinder body 10, and a plurality of flanges 11*a*, 11*b*. Each of the flanges 11*a*, 11*b* projects outward radially from an outer surface of the cylinder body 10. An end of an optical fiber cable 7 is attached to each base 4*b* (FIG. 4) of the ferrule 4. Each ferrule 4 receives the end of each optical fiber cable 7.

As shown in FIG. 4, the optical fiber cable 7 has an optical fiber 8 made of transparent material, and sheathing 9. This optical fiber 8 is a well-known multi-mode plastic optical fiber having a core and a clad, of which refractive indexes are different from each other, both of which are arranged coaxially. The sheathing 9 is made of insulating synthetic resin, sheathes, and protects the optical fiber 8.

The connector housing 5 is formed in a box-like shape by a plurality of outer walls 15, which is molded in one piece, and made of synthetic resin. The connector housing 5 has a pair of openings 16 and a plurality of through holes 17. Each opening 16 opens at each of a pair of outer walls 15*a* facing each other among the outer walls 15. In this description, a direction that the pair of outer walls 15*a* faces to each other (indicated by an arrow S in FIGS. 3 and 4) is a width direction of the connector housing 5, namely a width direction of the optical connector 3. Each opening 16 penetrates the corresponding outer wall 15*a*, and has a rectangular shape.

The through holes 17 are formed in a pair of outer walls 15*a*, 15*b* of the connector housing 5. The outer walls 15*a* and 15*d* are arranged on the connector housing 5 in FIGS. 3 and 4. Among the through holes 17, the through holes formed in the outer wall 15*c* are defined as through holes 17*a*, and the through holes formed in the outer wall 15*d* are defined as through holes 17*b*.

Four of the through holes 17*a*, 17*b* are formed in each of the outer surfaces 15*c*, 15*d*. Each of the through holes 17*a*, 17*b* has a circular shape. An inner diameter of the through hole 17*a* formed in the outer wall 15*c* is smaller than an outer diameter of the flanges 11*a*, 11*b* of the ferrule 4. An inner diameter of the through hole 17*b* formed in the outer wall 15*d* is equal to an outer diameter of the flange 11. Further, the through hole 17*a* and the through hole 17*b* are arranged coaxially.

According to the structure of the connector housing 5, after the opening 16 receives an end 4*a* of the ferrule 4 through the through hole 17*b*, the end 4*a* is arranged outside the connector housing 5 through the through hole 17*a*. The flange 11*a* is arranged inside the connector housing 5 in contact with an inner surface of the outer wall 15*c*, namely the connector housing 5. Further, the connector housing 5 receives a part of the ferrule 4 extending from the flange 11*a* to the flange 11*b* inside the opening 16.

The flat spring 6 is made of a metal plate having a specific thickness, and formed by bending the metal plate. A pair of flat springs 6 is received inside the opening 16 by the connector housing 5. In the connector housing 5, each flat spring 6 urges the ferrule 4 in a direction that the end 4*a* of the ferrule 4 is projecting outward from the connector housing 5.

According to the structure of this embodiment, the optical connector 3 is assembled as described below. Firstly, an end of the optical fiber cable 7 is attached to the base 4*b* of each ferrule 4. Secondly, the end 4*a* of each ferrule 4 is inserted into the connector housing 5 through each through hole 17*b*, and then projected outside from the connector housing 5 through each through hole 17*a*. Thirdly, each flat spring 6 is inserted into the connector housing 5 through the opening 16 to urge the ferrule 4 in a direction that the end 4*a* of the ferrule 4 is projecting outward from the connector housing 5. Thus, the optical connector 3 is assembled.

Figure 5:
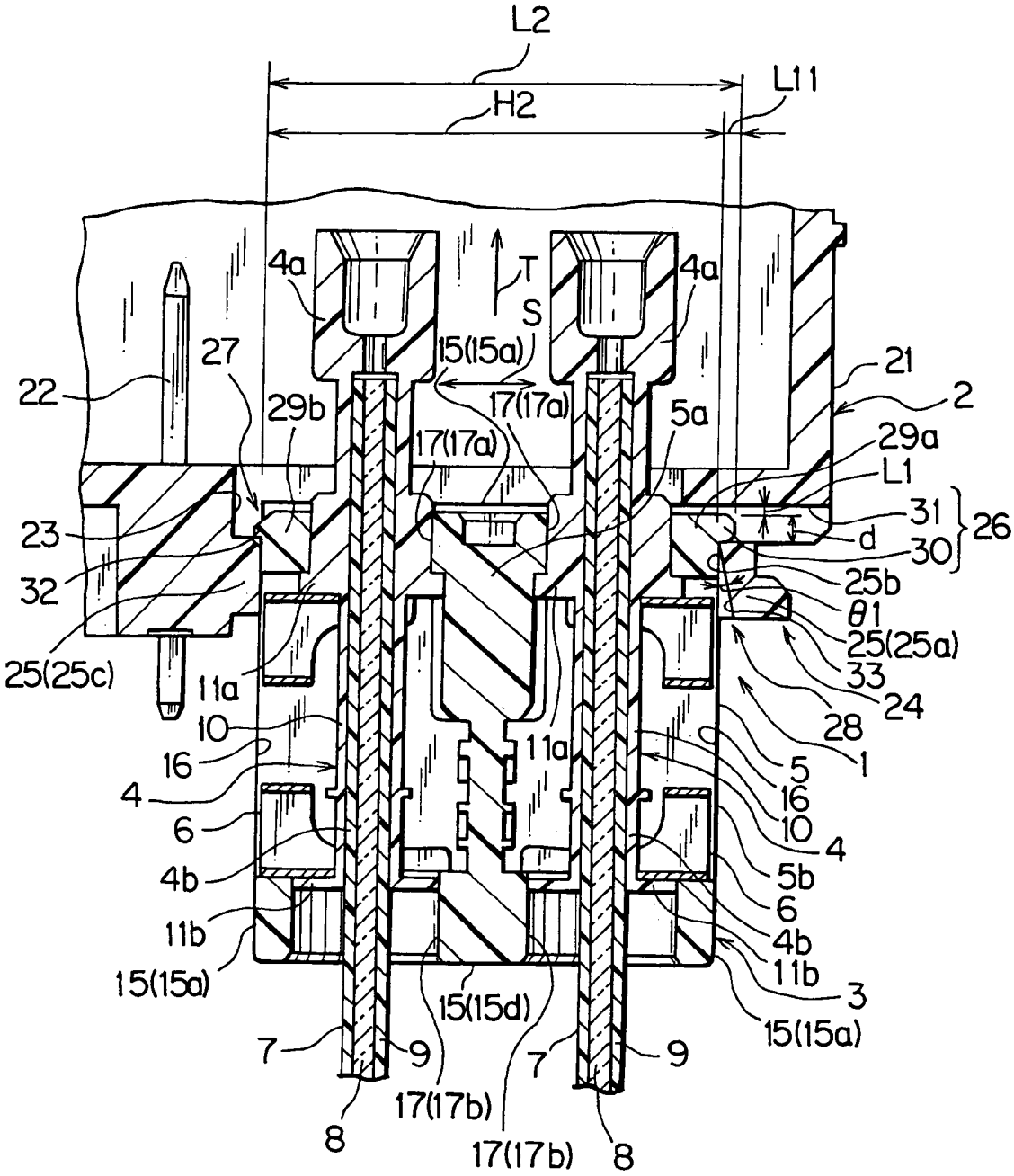
FIG. 5 is a section view taken in line V—V of FIG. 1.

In the structure 1 of a removable electrical connector, the optical connector 3 is attached to and removed from the receiving part 24. As shown in FIG. 5, said structure 1 has a pivoting part 26, an engaging and disengaging part 27, and a rotation allowing part 28.

The pivoting part 26 is provided on a first edge 29*a* of the end part 5*a* of the connector housing 5, the edge is one of the edges facing each other in a width direction of the connector housing 5 as an arrow S in FIGS. 2 to 4. As shown in FIG. 5, the pivoting part 26 has a pivot projection 30 and a hole 31 as a concave. The pivot projection 30 is formed on the first edge 29*a*. The pivot projection 30 is projected outward from the edge 29*a* along the arrow S.

When the receiving part 24 receives the end part 5*a* of the connector housing 5, one (hereinafter referred to as "25*a*") of the four beams 25 of the receiving part 24 faces the first edge 29*a* of the connector housing 5. The hole 31 is formed on an inner surface 25*b* of the beam 25*a*, namely formed on an inner surface of the receiving part 24. The hole 31 penetrates the beam 25*a* in the width direction of the connector housing 5, namely along the arrow S. Therefore, the hole 31 is formed as a concave inward from the inner surface 25*b*. The pivot projection 30 is inserted into the hole 31. Further, when receiving the pivot projection 30, the hole 31 has a space in an insertion direction of the connector housing 5, indicated by an arrow T (shown in FIGS. 1 and 5) perpendicular to the arrow S.

Therefore, when the pivot projection 30 is in the hole 31, the pivot projection 30 is movable along the arrow T.

Therefore, after the pivot projection 30 is inserted into the hole 31, the pivoting part 26 supports the connector housing 5 rotatably around the first edge 29*a*.

The engaging and disengaging part 27 has the engaging projection 32. The engaging projection 32 is formed on the edge 29*b* of the end part 5*a* of the connector housing 5 opposed to the first edge 29*a* in the arrow S direction. The engaging projection 32 projects outward from the edge 29*b* of the connector housing 5 along the arrow S. The engaging projection 32 can be engaged inside a beam 25*c* opposed to the beam 25*a*. Namely, the engaging projection 32 can be engaged with the receiving part 24. In the engaging and disengaging part, by engaging or disengaging the engaging projection 32 in the receiving part 24, the second edge 29*b* is engaged with, or disengaged from the receiving part 24.

The rotation allowing part 28 has the inclined surface 33. The inclined surface 33 is formed as the inner surface 25*b* of the beam 25*a*. The inclined surface 33 is inclined outward from the receiving part 24, namely, outward from the electronic equipment 2. The inclined surface 33 is inclined against both the arrows S and T.

Because of the presence of the inclined surface 33, the rotation allowing part 28 allows the connector housing 5 to be rotated around the pivoting part 26.

In the structure 1, as shown in FIG. 5, L1 is a difference between the width (depth) d of the hole 31 in the arrow T direction and a width (depth) of the pivot projection 30 in the arrow T direction. L11 is a projection length of the pivot projection 30 from the first edge 29*a* in the arrow S direction. As shown in FIG. 5, θ1 is an angle between the inclined surface 33 and an outer surface 5*b* of the connector housing 5 adjacent to the first edge 29*a*, said connector housing 5 being in a first state where the pivot projection 30 is in the hole 31, the engaging projection 32 is engaged with the receiving part, and the connector housing 5 is urged in an outward direction from the receiving part 24. Namely, θ1 is an angle between a reverse direction of the arrow T and the inclined surface 33. These difference the width d, L1, projecting length L1, and angle θ1 satisfy the formula (5).

Further, θ2 is an angle between the outer side surface 5*b* of the connector housing 5 adjacent to the first edge 29*a* in said first state, and the same outer side surface 5*b* of the connector housing 5 in a second state (shown as an alternate long and short dash line in FIG. 6), said connector housing 5 being in the second state where the pivot projection 30 is in the hole 31, the engaging projection 32 is engaged with the receiving part 24, and the connector housing 5 is urged outward from the receiving part 24, and in a state where the pivot projection 30 is in the hole 31, the engaging projection 32 is engaged with the receiving part 24, the first edge 29*a* side of the connector housing 5 is urged in an inward direction from the receiving part, and the second edge 29*b* side of the connector housing 5 is urged in an outward direction from the receiving part 24. These angles θ1, θ2 satisfy the formula (6).

Further, L2 is a sum of the width H2 of the connector housing 5 in the arrow S direction and the projecting length 11 of the pivot projection 30. The sum L2 and the angle θ2 satisfy the formula (7).

Figure 6:
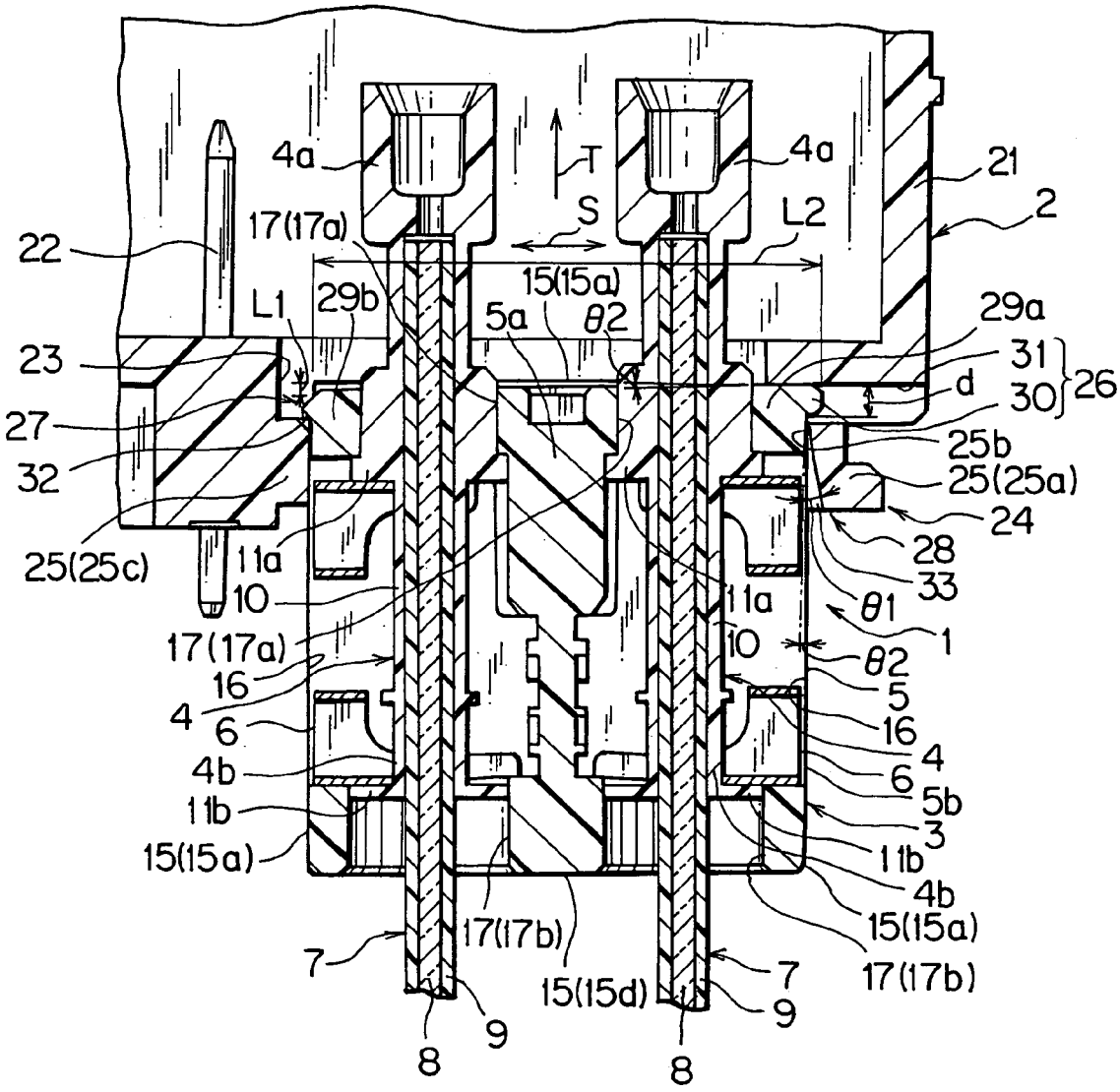
FIG. 6 is a section view showing the optical connector and the electrical equipment of FIG. 5, a pivot projection of the connector being urged in an inward direction from a receiving part of the electrical equipment, an engaging projection of the optical connector being urged in an outward direction from the receiving part.
Figure 7:
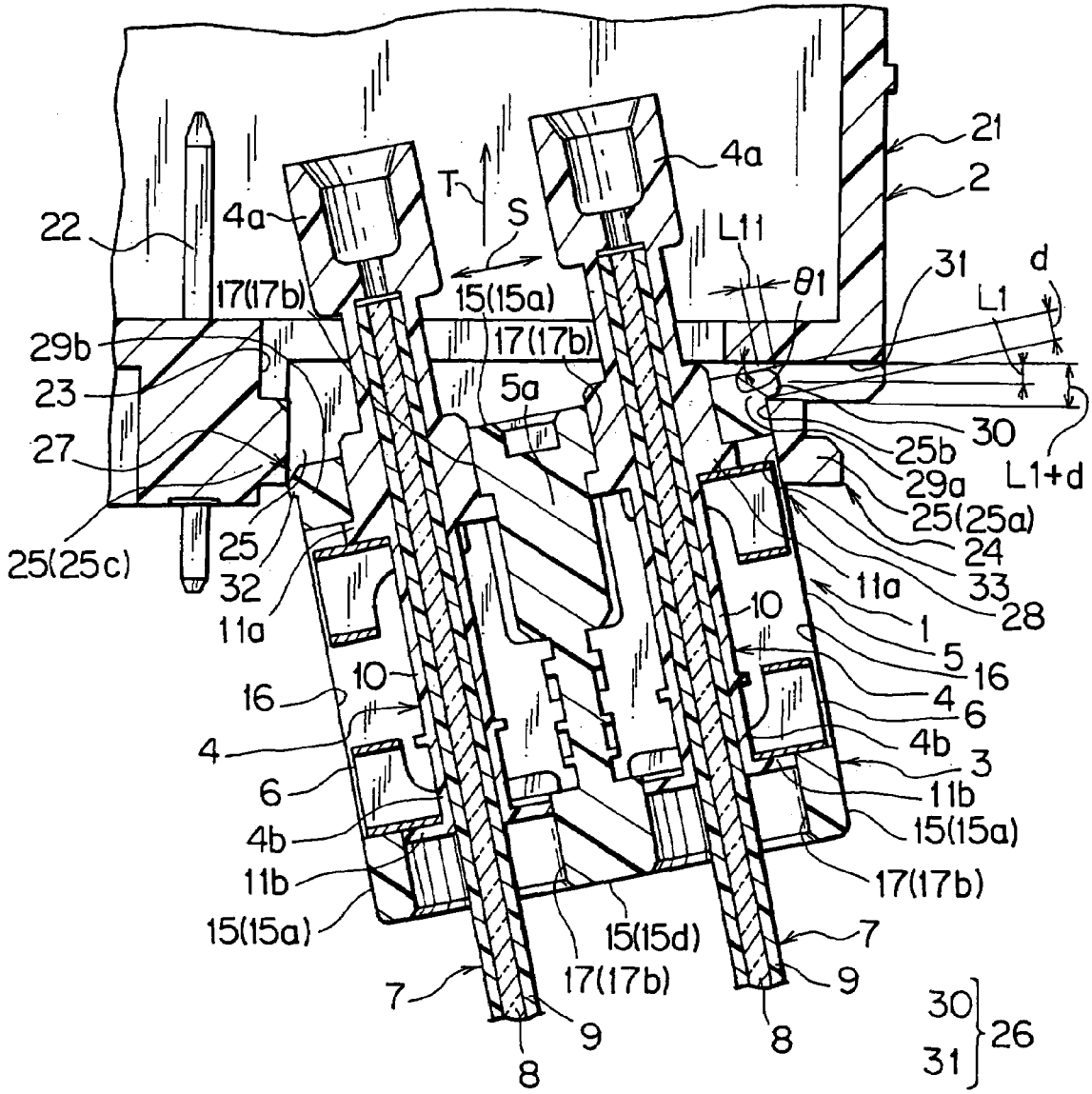
FIG. 7 is a section view showing the optical connector and the electrical equipment of FIG. 6, being just removed from each other.
Figure 8:
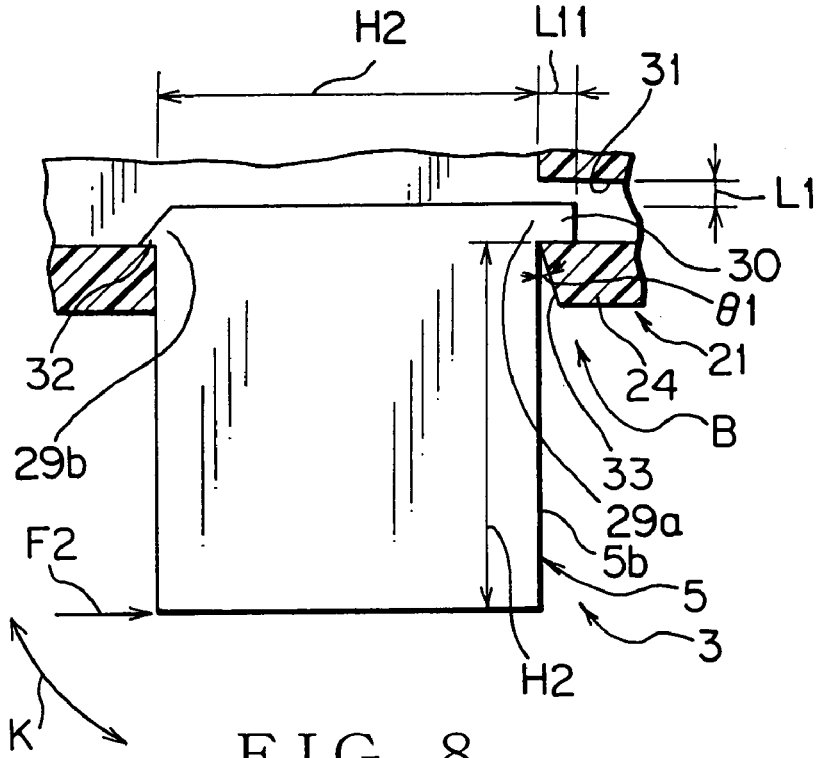
FIG. 8 is a partially sectional schematic view for explaining the structure of the removable electrical connector according to the present invention.
Figure 9:
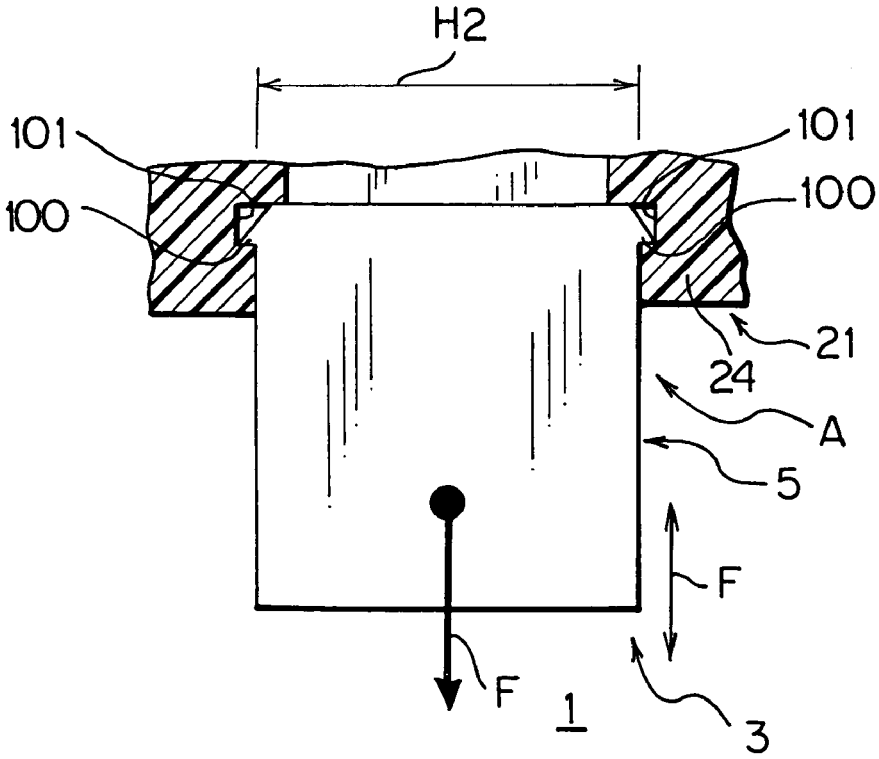
PRIOR ART FIG. 9
FIG. 9 is a partially sectional schematic view for explaining a structure of a conventional removable electrical connector.
Figure 10:
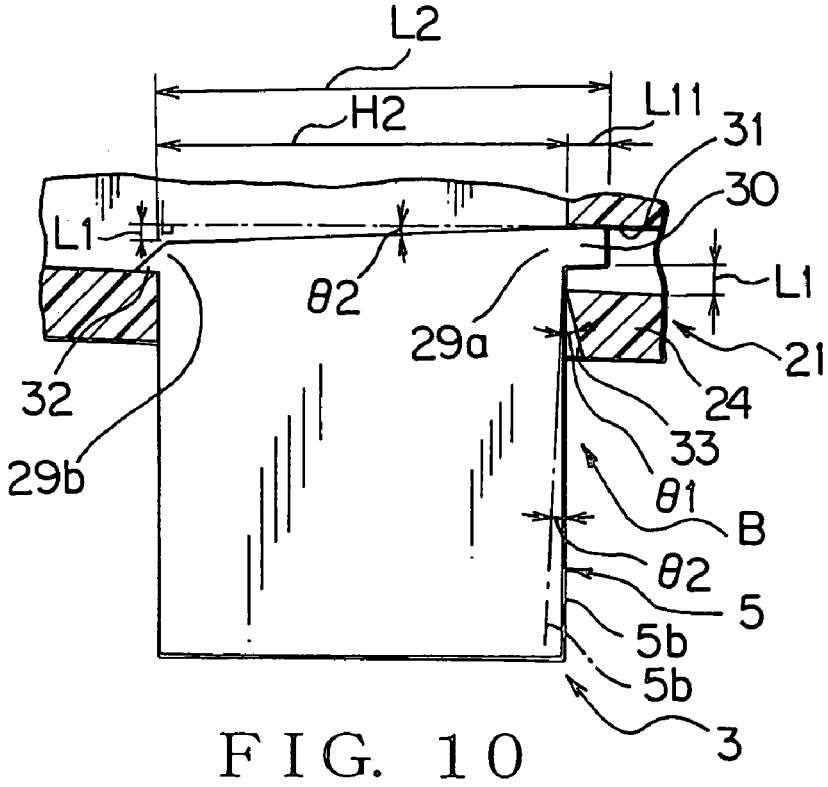
FIG. 10 is a partially sectional schematic view for explaining the structure of the removable electrical connector of FIG. 8, a pivot projection of the connector being urged in the inward direction from the receiving part, an engaging projection of the connector being urged in the outward direction from the receiving part.
Figure 11:
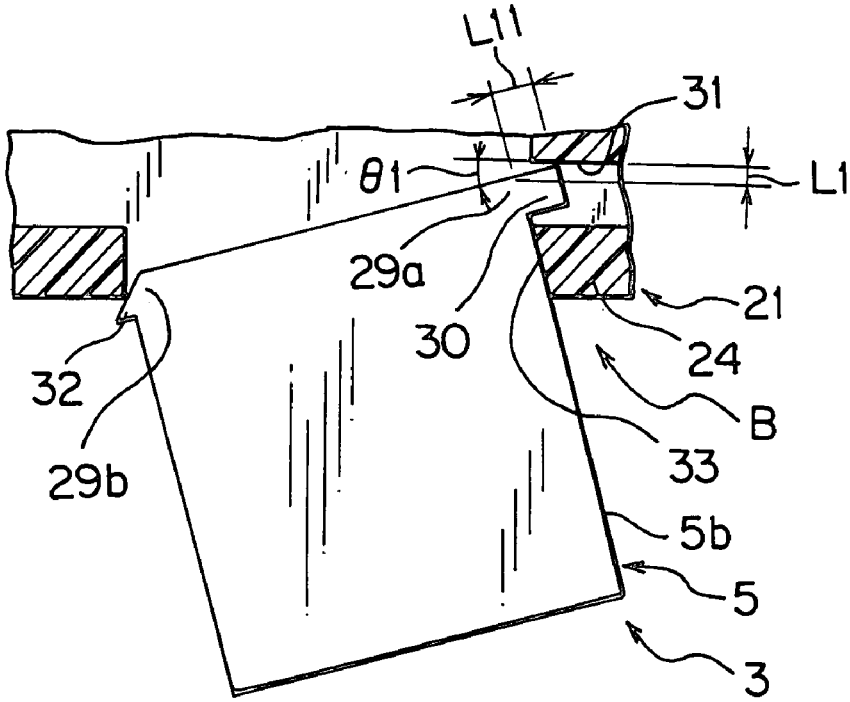
FIG. 11 is a partially sectional schematic view for explaining the structure of the removable electrical connector of FIG. 10, the engaging projection of said connector being just disengaged.
Figure 12:
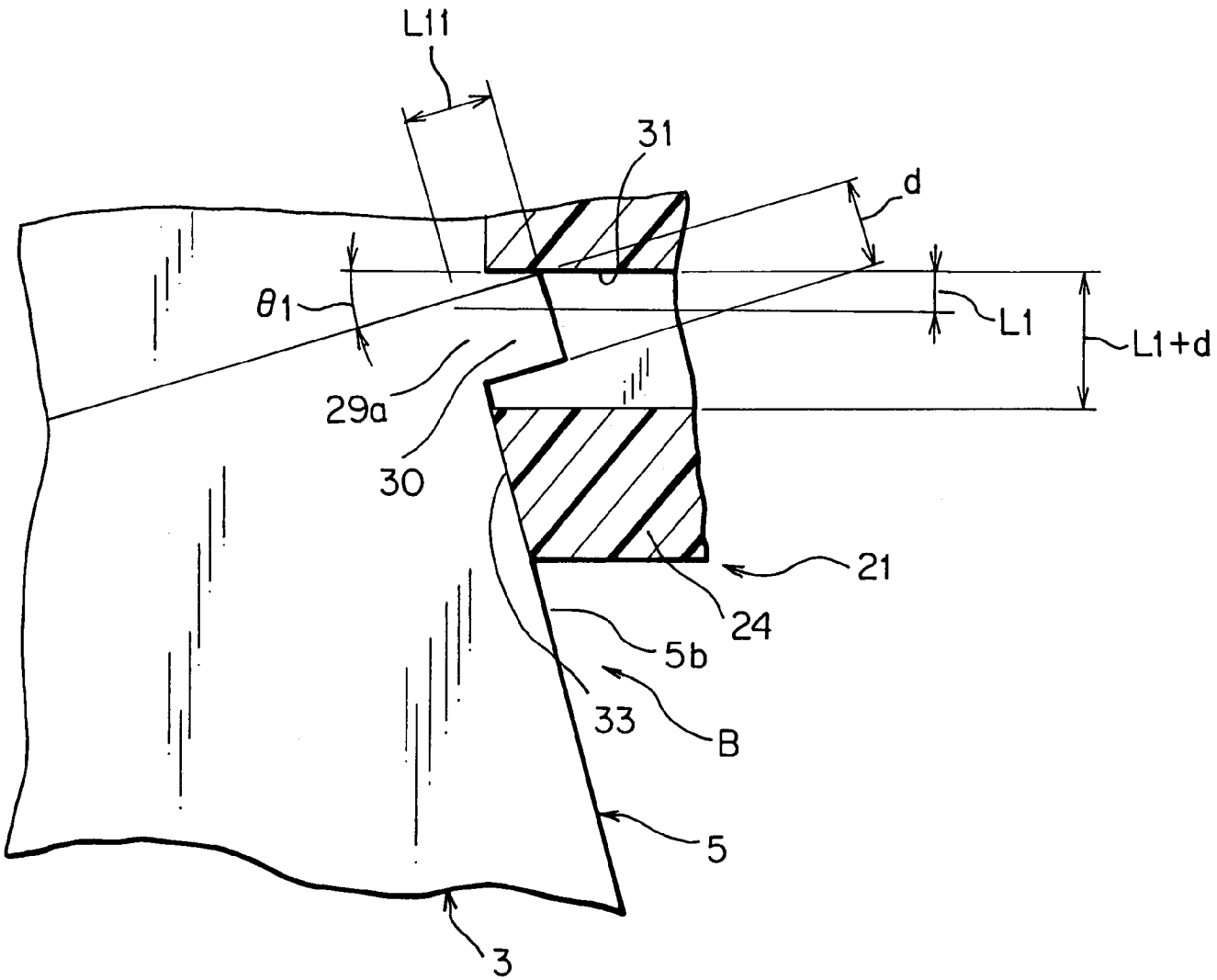
FIG. 12 is a partially enlarged cross section view for explaining the structure of the removable electrical connector of FIG. 11.

In the structure 1, as shown in FIG. 7, for attaching the optical connector 3 to the receiving part 24 of the electrical equipment 2, firstly while the outer side surface 5*b* is in face-contact with the inclined surface 33, the pivot projection 30 is inserted into the hole 31. Secondly, the optical connector 3 is rotated around the pivot projection 30 in the hole 31, namely, around the pivoting part 26 to insert the end part 5*a* of the connector housing 5 into the receiving part 24. Then, the beam 25*c* of the receiving part 24 and the engaging projection 32 come in contact with each other to deform resiliently the beam 25*c* for enlarging the opening of the receiving part 24, and the engaging projection 32 for reducing the projection length from the connector housing 5. Finally, as shown in FIGS. 5 and 6, the engaging projection 32 is engaged with the receiving part 24, and the optical connector 3 is attached to the electrical equipment 2.

According to the structure 1, as shown in FIG. 5, for removing the optical connector 3 from the receiving part 24 of the electrical equipment 2, firstly the first edge 29*a* is urged inward from the receiving part 24, while the second edge 29*b* is urged outward from the receiving part 24. Then, as shown in FIG. 6, the pivot projection 30 comes in contact with an inner side surface of the hole 31, while the engaging projection 32 comes in contact with an inner surface of the beam 25*c* of the receiving part 24.

Secondly, the optical connector 3 is rotated around the pivot projection 30 in the hole 31, namely, around the pivoting part 26, to release the end part 5*a* of the connector housing 5 from the receiving part 24. Then, the beam 25*c* of the receiving part 24 and the engaging projection 32 come in contact with each other to deform resiliently the beam 25*c* for enlarging the opening of the receiving part 24, and the engaging projection 32 for reducing the projection length from the connector housing 5. Then, as shown in FIG. 7, the engaging projection 32 is disengaged from the receiving part 24 to remove the optical connector 3 from the receiving part 24 of the electrical equipment 2.

According to this embodiment, by rotating the connector housing 5 around the pivoting part 26, the engaging and disengaging part 27 of the optical connector 3 is engaged with and disengaged from the receiving part 24. Therefore, according to the principle of leverage, by pressing a distant position from the pivoting part 26 along the arrow S, the engaging and disengaging part 27 is engaged and disengaged. In this case, the force for engaging and disengaging the engaging and disengaging part 27 can be reduced. Namely, the optical connector 3 can be attached and removed by said force smaller than the force in a longitudinal direction of the ferrule 4 as the metal terminal received by the connector housing 5.

Therefore, an operation of attaching and removing the optical connector 3 becomes easier to improve the workability of this operation.

Because the optical connector 3 can be removed by relatively weak force, no tool is needed for removing the optical connector 3. Therefore, the optical connector 3 is prevented from being damaged accidentally by the tool.

Therefore, the optical connector 3 can be easily attached to and removed from the receiving part 24 without being damaged.

Because the pivot projection 30 is movable in the hole 31 along the arrow T, when the connector housing 5 is rotated around the pivoting part 26, the pivot projection 30 is prevented from being blocked by the inner walls of the hole 31.

Further, because the inclined surface 33 is inclined outward from the receiving part 24, when the connector housing 5 is rotated around the pivoting part 26, the outer side surface 5*b* of the connector housing 5 is prevented from being blocked by the inclined surface 33.

Therefore, the connector housing 5, namely, the optical connector 3 is reliably rotated around the pivoting part 26, and the optical connector 3, is reliably attached to and removed from the receiving part 24.

Because the formula (5) is satisfied, the pivot projection 30 is reliably inserted into the hole 31. Namely, the optical connector 3 is reliably attached to the receiving part 24. Further, because the formula (6) is satisfied, the optical connector 3 is reliably removed from the receiving part 24. Thus, the optical connector 3 is reliably attached to and removed from the receiving part 24.

Because the formula (7) is satisfied, the optical connector 3 is reliably removed from the receiving part 24.

In the structure 1, the optical connector 3 is attached to and removed from the receiving part 24 of the electrical equipment 2. However, according to the present invention, a well-known electric connector having metal terminals also can be attached to and removed from the receiving part 24 of the electrical equipment 2. Further, according to the present invention, a removable electrical connector is also attached to and removed from a mating removable electrical connector. In this case, a connector housing of the mating removable electrical connector corresponds to the receiving part 24.

In addition, the present invention is not limited to above described embodiments, and various changes and modifications can be made without departing from the spirit and scope of this invention.

What is claimed is:

1. A structure of a removable electrical connector having a connector housing comprising:

a receiving part having a frame-like opening to receive one end of the connector housing;

a pivoting part having a first edge of said one end of the connector housing around which said connector housing is rotatable;

an engaging and disengaging part having a second edge opposite said first edge of the connector housing, said second edge being engaged with and disengaged from the receiving part;

a rotation allowing part for allowing said connector housing to be rotated around the pivoting part, whereby when the connector housing is rotated around the pivoting part, the engaging and disengaging part is engaged with and disengaged from the receiving part and the removable electrical connector is attached to and removed from the receiving part, wherein said pivoting part further includes a pivot projection projecting outward from the first edge of the connector housing, and a concave formed at an inner side surface of the receiving part to receive the pivot projection movably, and wherein said rotation allowing part includes one inclined surface at an inner side of the receiving part adjacent to the pivoting part, said inclined surface being inclined outward from the receiving part.

2. The structure of a removable electrical connector as claimed in claim 1, wherein said engaging and disengaging part further includes an engaging projection projecting outward from said second edge of the connector housing to be engaged with the receiving part, wherein said rotation allowing part includes one inclined surface at an inner side of the receiving part adjacent to the pivoting part, said inclined surface being inclined outward from the receiving part, wherein in a state where said pivot projection is inserted into said concave, and said engaging projection is engaged with the connector housing, the pivot projection is movable in a insertion direction of the connector housing.

3. The structure of a removable electrical connector as claimed in claim 2, satisfying the following relations:

$$L11*\sin\theta1-d*(1-\cos\theta1)\leqq L1$$

$$\theta2<\theta1,$$

wherein d is a width of said pivot projection,

L1 is a difference between a width of said concave in an insertion direction of the connector housing to the receiving part and the width d of said pivot projection, L11 is a projection length of said pivot projection, θ1 is an angle between said inclined surface and an outer side surface of the connector housing adjacent to the first edge, said connector housing being in a first state where the pivot projection is in the concave, the engaging projection is engaged with the receiving part, and the connector housing is urged in an outward direction from the receiving part, and θ2 is an angle between the outer side surface of the connector housing adjacent to the first edge in said first state, and the same outer side surface of the connector housing in a second state, said connector housing being in the second state where the pivot projection is in the concave, the engaging projection is engaged with the receiving part, the first edge of the connector housing is urged in an inward direction from the receiving part, and the second edge of the connector housing is urged in an outward direction from the receiving part.

4. The structure of a removable electrical connector as claimed in claim 3, satisfying the following relation:

$$\theta2=\arcsin(L1/L2),$$

wherein L2 is a sum of said projection length of the pivot projection L11 and a width of said connector housing in a direction perpendicular to both first and second edges.

* * * * *